US009038841B2

(12) United States Patent
McPherson

(10) Patent No.: US 9,038,841 B2
(45) Date of Patent: May 26, 2015

(54) TAMPER-EVIDENT CLOSURE

(71) Applicant: Obrist Closures Switzerland GmbH, Reinach (CH)

(72) Inventor: Alexander Donald Meiklem McPherson, Falkirk (GB)

(73) Assignee: Obrist Closures Switzerland GmbH, Reinach (CH)

( * ) Notice: Subject to any disclaimer, the term of this patent is extended or adjusted under 35 U.S.C. 154(b) by 38 days.

(21) Appl. No.: 13/824,919

(22) PCT Filed: Nov. 28, 2012

(86) PCT No.: PCT/EP2012/073859
§ 371 (c)(1),
(2) Date: Mar. 18, 2013

(87) PCT Pub. No.: WO2013/079545
PCT Pub. Date: Jun. 6, 2013

(65) Prior Publication Data

US 2014/0054288 A1 Feb. 27, 2014

(30) Foreign Application Priority Data

Nov. 28, 2011 (GB) ..... 1120522.6

(51) Int. Cl.
*B65D 41/34* (2006.01)
*B65D 43/02* (2006.01)
(Continued)

(52) U.S. Cl.
CPC ..... *B65D 43/0283* (2013.01); *B65D 41/34* (2013.01); *B65D 49/02* (2013.01); *B65D 55/026* (2013.01); *B65D 2101/0023* (2013.01)

(58) Field of Classification Search
CPC .. B65D 43/0283; B65D 55/026; B65D 41/34; B65D 49/02; B65D 2101/0023
USPC ..... 215/250, 253, 254, 256, 251, 252, 901; 220/255, 255.1, 256.1, 257.1, 257.2, 220/258.1, 258.2, 258.3, 254.1, 254.2, 220/254.8, 254.9
See application file for complete search history.

(56) References Cited

U.S. PATENT DOCUMENTS 3,415,403 A * 12/1968 Bardell ..... 215/252
4,540,100 A 9/1985 Willis
(Continued)

FOREIGN PATENT DOCUMENTS

GB 2390086 A 12/2003
GB 2450939 A 1/2009
(Continued)

OTHER PUBLICATIONS

European Patent Office, International Search Report and Written Opinion of PCT/EP2012/073859, Mar. 6, 2013, 15 pages.
(Continued)

*Primary Examiner* — Robert J Hicks
*Assistant Examiner* — Kareen Rush
(74) *Attorney, Agent, or Firm* — Alleman Hall McCoy Russell & Tuttle LLP

(57) ABSTRACT

A tamper-evident closure for a container comprises two or more parts and is movable from a first position to a second position in an opening event, the movement to the second position generating two or more gaps between and/or within the parts, the closure further comprising means for preventing closing of the gaps whereby to confirm the opening event has occurred.

17 Claims, 6 Drawing Sheets

(51) Int. Cl.
*B65D 49/02* (2006.01)
*B65D 55/02* (2006.01)

(56) References Cited

U.S. PATENT DOCUMENTS 5,680,965 A * 10/1997 Beck ..... 222/153.06
5,829,611 A * 11/1998 Beck ..... 215/252
6,059,131 A * 5/2000 Harris ..... 215/18
6,908,013 B2 * 6/2005 Thomson et al. ..... 222/153.06

FOREIGN PATENT DOCUMENTS

WO 02096771 A1 12/2002
WO 2004011347 A2 2/2004
WO 2006117505 A1 11/2006
WO 2011133067 A1 10/2011

OTHER PUBLICATIONS

Intellectual Property Office of Great Britain, Search Report of British Patent Application No. GB1120522.6, Mar. 5, 2012, 1 page.

* cited by examiner

TAMPER-EVIDENT CLOSURE

CROSS-REFERENCE TO RELATED APPLICATIONS

The present application is the U.S. National Phase of International PCT Application Serial No. PCT/EP2012/073859, entitled "A Tamper-Evident Closure," filed Nov. 28, 2012, which claims priority to Great Britain Application No. 1120522.6, filed Nov. 28, 2011, each of which are hereby incorporated by reference in their entirety for all purposes.

The present invention relates generally to a closure for a container and particularly to a closure with means for indicating that the closure has been opened at least once.

There is an increasing demand for tamper-indicating systems which ensure that a container is not re-filled with non-original contents. Whilst it is relatively easy to produce some form of tamper-evidence, it is much more difficult to provide tamper-evidence which cannot be either overcome without causing the tamper-evidence system to activate, or activated and then returned to a visually identical state so as to appear non-activated.

A particularly useful method of providing tamper-evidence is to use a system in which a closure is initially located into a first position, but once removed can only be returned to a second position which is visually distinct from the first position. For example, U.S. Pat. No. 5,738,231 describes a closure with a part which is moved during the opening process so that following opening it cannot pass back over a projection on the container finish. The result is that the closure can only return to a position in which it is axially displaced with respect to its original position.

Document WO 02/096771 describes a closure with a first portion with inner and outer parts, and a second portion. Initially a section of the inner part of the first portion protrudes below the level of the second portion which is formed so as to have a reduced circumference. When the first portion is removed the section of the inner part is pulled from under the area of reduced circumference on the second portion. After removal the inner part of the first portion and the area of reduced circumference on the second portion retain their original dimensions, so that if the first portion is reapplied the inner part can no longer pass under the area of reduced circumference.

Documents WO2005/049449 and WO2006/117505 describe a tamper-evident closure with a first portion including inner and outer parts, and a second portion. The outer part is movable relative to the inner part from a first position in which the outer part is immediately adjacent the second portion to a second position in which there is an unobstructed gap therebetween. The inner and outer parts are adapted to become irreversibly locked in the second position so that the outer part cannot be moved back to the first position to close the gap so as to provide an irreversible event which gives evidence of opening.

According to an aspect of the present invention there is provided a tamper-evident closure for a container, the closure comprising two or more parts and being movable from a first position to a second position in an opening event, the movement to the second position generating two or more gaps between and/or within the parts, the closure comprising means for preventing closing of the gaps whereby to confirm the opening event has occurred.

According to a further aspect of the present invention there is provided a tamper-evident closure for a container, the closure including an outer shell and being movable from an unactivated, first position to an activated, second position in an opening event, the shell being separable into three or more parts in the opening event so as to form two or more gaps, the closure comprising means for preventing closing of the gaps whereby to confirm the opening event has occurred.

Some or all of the gaps may be generated sequentially. Alternatively or additionally some or all of the gaps may be generated substantially simultaneously.

At least one of the gaps may be unobstructed. Alternatively or additionally at least one of the gaps may be obstructed.

By 'unobstructed' is meant there is no obstruction at or through the gap. The closure thereby does not rely on an obstructing member becoming trapped at or in the gap. By forming an unobstructed gap it is not possible to defeat the tamper-evidence by a simple cutting operation through the gap. In other words, the locking mechanism may be remote from the gap.

At least one gap may generated by rotation, for example relative rotation between two parts. Alternatively or additionally at least one gap may be generated by axial separation, for example by pulling two parts apart or away from each other.

The closure may comprise a shell. A metal (such as aluminium) shell, cowl or the like may be provided to house the working components. The gap may be formed in the shell. First and second portions of a closure may include respective first and second shell parts between which the gap is formed. The shell parts may be joined by a line of weakness when the closure is in the unopened state. For example a frangible line may be provided in the shell, the gap being formed between adjacent peripheries of two shell parts along which the line extends.

The means for preventing closing of the gaps may include one or more ratchet arrangements. Such mechanisms are known, for example, from documents WO2005/049449 and WO2006/117505. The closure may therefore include a ratchet arrangement for preventing return to the first position, for example by locking inner and outer parts in a second position. A ratchet arrangement is a simple and efficient method of irreversibly locking the inner and outer parts together.

In some embodiments only two gaps are generated. In other embodiments three or more gaps may be generated.

The gaps may be generated at least in part using differential torque between sections of the closure.

A second portion of a closure may be attachable to a container. For example the second portion may be attachable to the mouth and neck region of a container. In some embodiments the second portion may be snap-fitable onto a container. Roll-on-pilfer-proof (ROPP) arrangements are also contemplated.

The closure may comprise or include a pouring fitment. A top part of the shell may be friction fitted to the pouring fitment.

The closure may further comprise a non-return valve. Certain industries, in particular the spirits industry, demand additional measures to prevent tampering. In-bore fitments such as non-return fitments are often fitted to containers to prevent re-filling regardless of other tamper-evidence measures.

The closure may include formations, such as screw threads, for engagement on the container or in-bore fitment as appropriate. In such cases the cap ratchet arrangement or other locking mechanism may be located above the formations so as to increase the difficulty in accessing and tampering with the locking arrangement.

According to a further aspect of the invention, there is provided a tamper-evident closure for a container, the closure including an outer shell having two or more parts and being movable from a first position to a second position in an opening event, the movement to the second position generating a single gap between and/or within the parts, the closure comprising means for preventing closing of the single gap and a pouring fitment, wherein a top part of the outer shell is friction fitted to the pouring fitment.

The top part of the outer shell may be engaged with the pourer body by a push fit arrangement, such that removal of the top part of the outer shell in an opening event causes an audible sound to be generated. The audible sound may be a pop sound. Further, in addition or as an alternative to the audible sound, a vibration or other tactile sensation may be provided to the user as a result of the opening event. An audible sound and/or tactile sensation may be provided to the user in a closing event.

By providing a sound and/or tactile sensation to the user as a result of an opening and/or closing event, the user experience of opening and/or closing the closure may be improved.

The present invention also provides in combination a closure as described herein and a container.

The present invention will now be more particularly described, by way of example, with reference to the accompanying drawings, in which.

Figure 1:
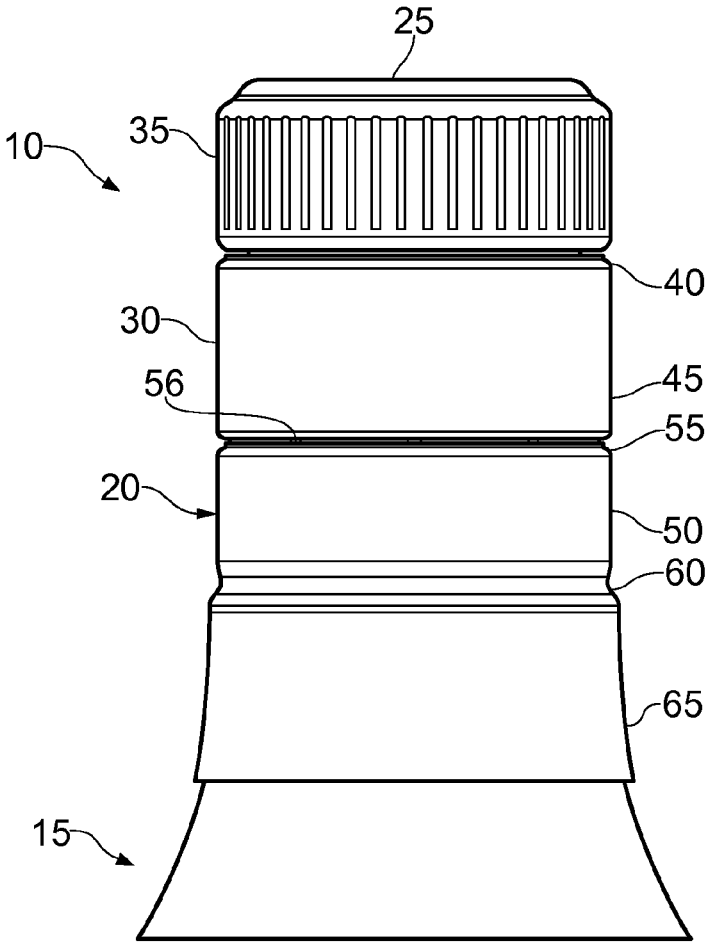
FIG. 1 is a side view of a tamper-evident closure formed according to the present invention and shown in an unopened position.

Referring first to FIG. 1 there is shown a tamper-evident closure generally indicated at 10 secured onto a container neck 15.

The closure 10 has an outer metal shell 20 which is generally cup-shape, having a disc-shape top plate 25 and a generally cylindrical tubular side wall 30 depending from the periphery thereof.

Below the top plate 25 the side wall 30 includes a plurality of longitudinally extending ribs forming a knurled region 35. Below the region 35 is a tuck-in bead 40 followed by two cylindrical regions 45, 50 divided by a further tuck-in bead 55. Below the region 50 is a further tuck-in bead 60 and the side wall terminates with a flared skirt region 65 at its open end.

In this embodiment the tuck-in bead 40 is cut centrally so that the sections 45, 35 are separate. The tuck-in bead 55 comprises a line of weakness defined by a plurality of frangible bridges 56 which connect the sections 45, 50.

Figure 2:
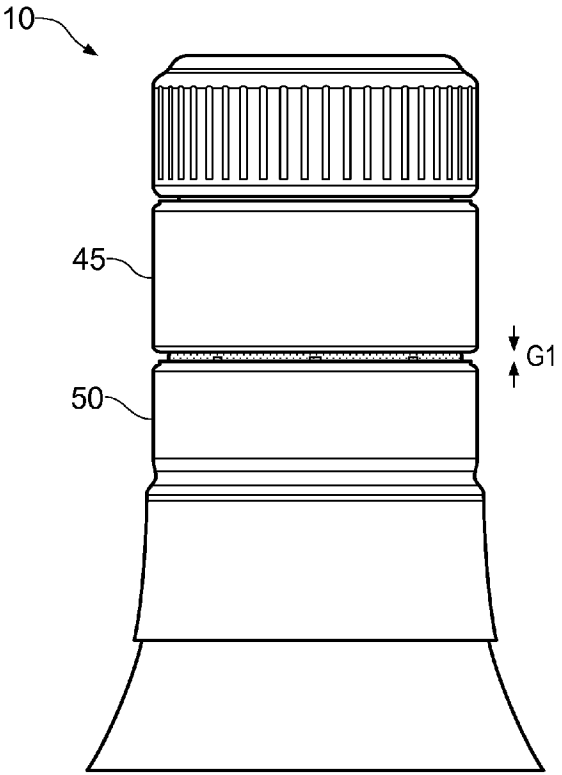
FIG. 2 is a side elevation of the closure of FIG. 1 shown after a first opening phase.

Referring now to FIG. 2, the closure of FIG. 1 is shown moved towards an open position via the intermediate position shown. In this position the upper part of the closure including the sections 35, 45 has been moved, in this embodiment by rotation, so that the sections 45, 50 become separated and the frangible line within the tuck-in bead 55 is broken. This creates a gap G1 between the adjacent peripheries of the shell sections 45, 50. The closure 10 comprises an internal ratchet mechanism for retaining the sections 45, 50 in the spaced apart relation so that the gap G1 cannot be closed.

Figure 3:
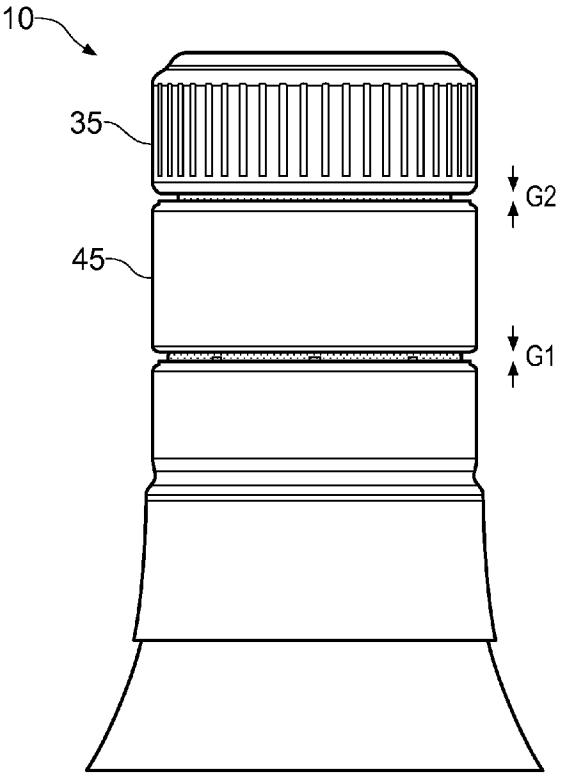
FIG. 3 is a side view of the closure of FIG. 2 shown following a second opening phase.

Further movement of the closure 10 towards the fully open position causes the shell sections 35, 45 to become separated as shown in FIG. 3 so that an additional gap G2 is formed. The closure 10 comprises an additional internal ratchet mechanism for maintaining the sections 35, 45 in the spaced apart relation so that the gap G2 cannot be closed.

The closure 10 can now be opened, which in this embodiment is achieved by removal of the section 35 to reveal a pouring aperture. When the top-cap-like section 35 is replaced it will only return to the position shown in FIG. 3 because neither of the gaps G1, G2 can be closed. This provides a visual indication that the closure has been moved away from the closed position.

Figure 4:
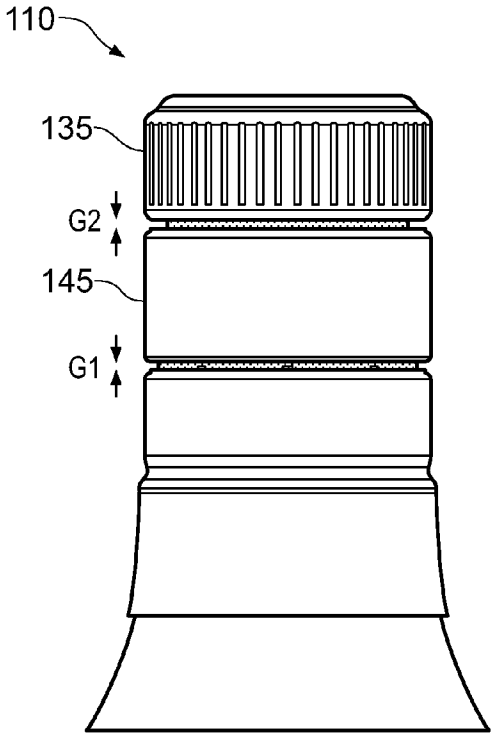
FIG. 4 is a side elevation of a tamper-evident closure formed according to an alternative embodiment and shown in an activated position.
Figure 7:
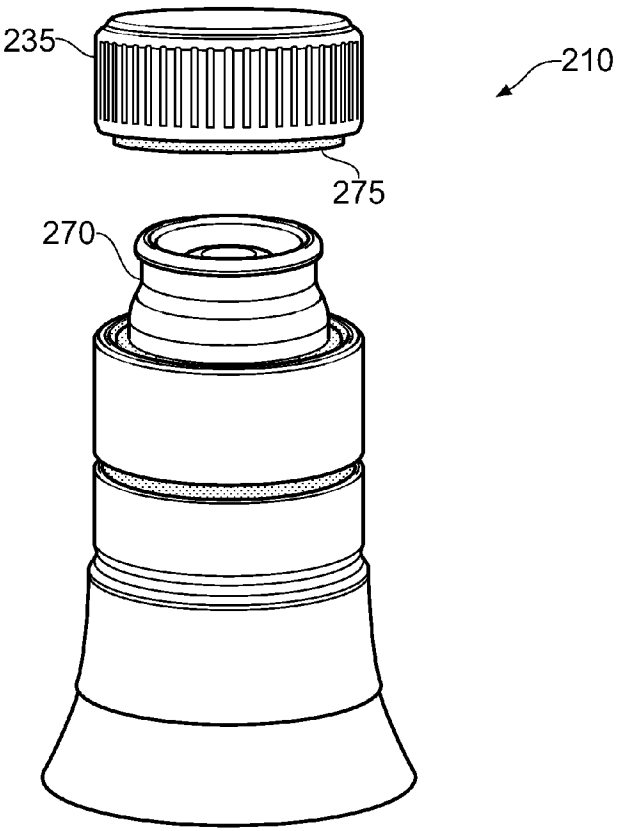
FIG. 7 is a perspective view of the closure of FIG. 6 shown with a top cap removed.

Referring now to FIG. 4 a closure 110 is shown which is very similar to the closure described in FIGS. 1 to 3. The closure 110 is shown in the activated position corresponding to FIG. 3 in which two gaps G1, G2 have been formed.

Figure 5:
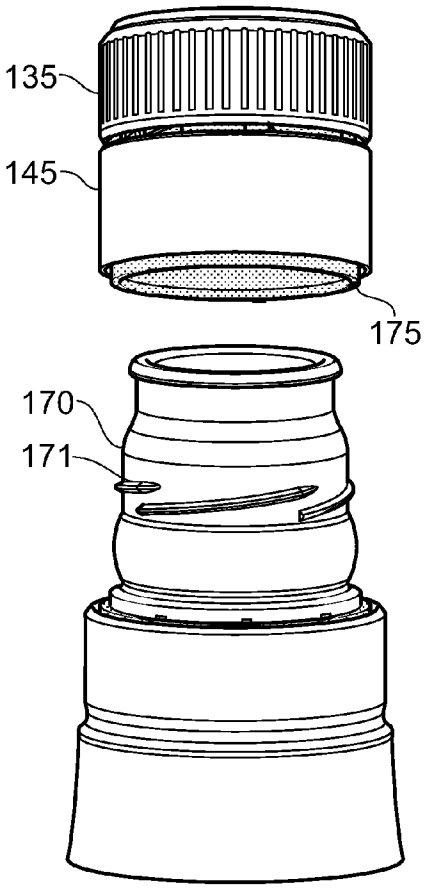
FIG. 5 is a perspective view of the closure of FIG. 4 shown with a top cap removed.

From the position shown in FIG. 4 the closure 110 is opened by rotating the part of the closure including these shell sections 135, 145 as shown in FIG. 5. This rotates that top cap section off a pourer body 170 which includes external screw thread formations 171 that co-operate with corresponding formations (not shown) provided on an internal ratchet component 175 within the shell sections 135, 145.

Dispensing of fluid, for example valuable liquor, can now be done through the pourer body 170. Following use the top cap is replaced onto the pourer body and the closure returns to the position shown in FIG. 4 in which neither of the gaps G1, G2 can be closed.

Figure 6:
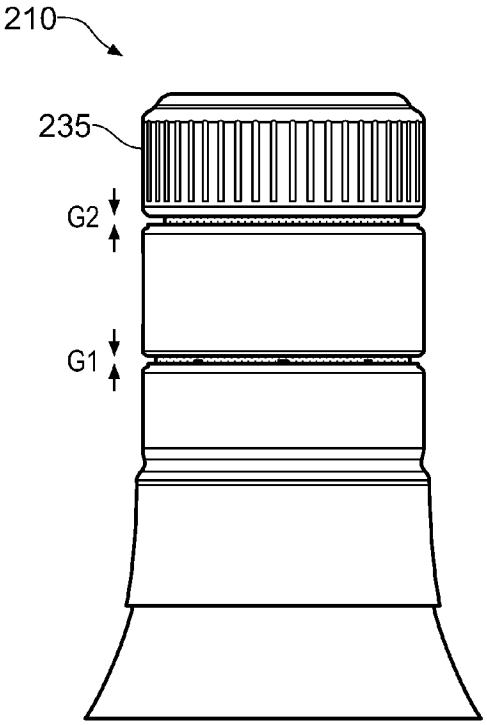
FIG. 6 is a side elevation of a closure formed according to an alternative embodiment and shown in an activated position.

Referring now to FIG. 6 there is shown a closure 210 formed according to an alternative embodiment. The closure 210 is very similar to the closures shown in FIGS. 1 to 5 and in FIG. 6 is shown in an activated position in which two gaps G1, G2 have already been generated in a similar way to FIGS. 3 and 4.

In this embodiment the closure is opened by removal of only the shell section 235 along with its internal ratchet components 275. The top cap provided by the shell section 235 and components 275 is friction fitted to the pourer body/fitment 270 so that it is lifted away to reveal the body 270. Once again, once the top-cap formed by 235, 275 is replaced the closure 210 returns to the position shown in FIG. 6 in which the gaps G1, G2 cannot be re-closed.

The top shell section 235 may be friction fitted to the pourer body 270 by a push fit arrangement, such that removal of the top shell section 235 in an opening event causes an audible sound to be generated. The audible sound may be a pop sound. Further, in addition or as an alternative to the audible sound, the top shell section 235 may be fitted to the pourer body 270 such that a vibration or other tactile sensation may be provided to the user as a result of the opening event. As will be appreciated, an audible sound and/or tactile sensation may also be provided as a result of a closing event in which the top shell section 235 is reapplied to the pourer fitment 270.

By providing a sound and/or tactile sensation to the user as a result of an opening and/or closing event, the user experience of opening and/or closing the closure may be improved.

Although the above describes the top shell 235 being friction fitted to the pourer body 270 in an embodiment in which two gaps are generated, it should be appreciated that the top shell 235 may be friction fitted to the pourer body 270 in embodiments in which two or more gaps are generated.

Figure 8C:
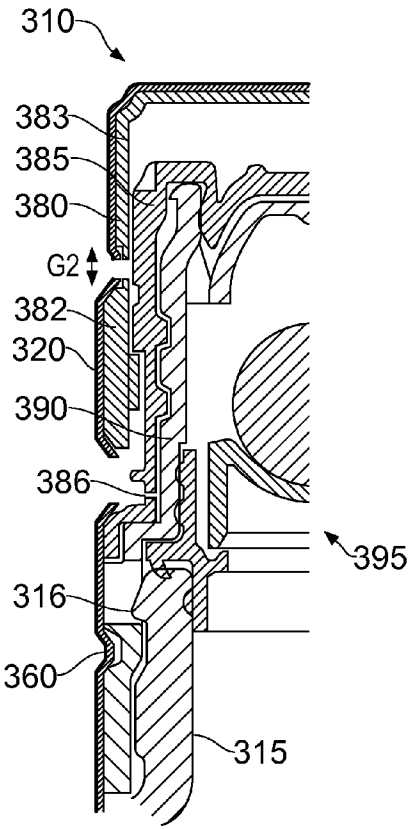
FIG. 8C is a section of the closure of FIG. 8A and shown in an end position.
Figure 8B:
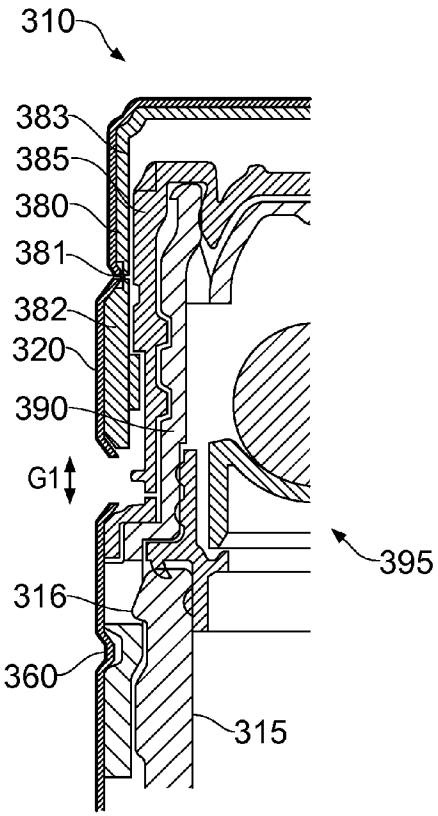
FIG. 8B is a section of the closure of the FIG. 8A and shown in an intermediate position.
Figure 8A:
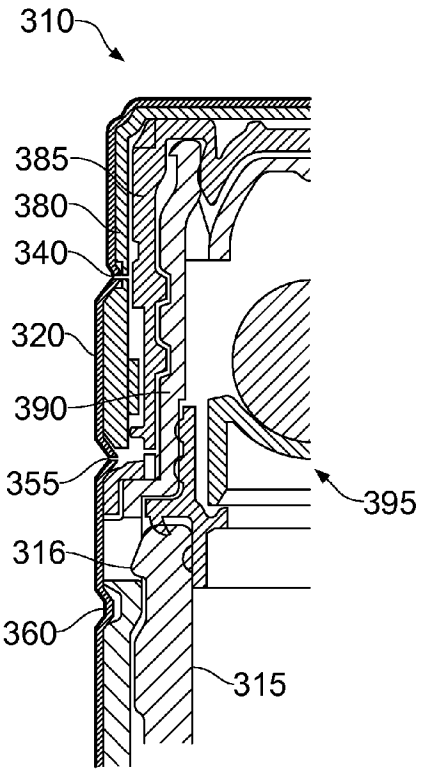
FIG. 8A is a section of a closure formed according to an alternative embodiment and shown in a closed position.

Referring now to FIG. 8A there is shown a closure 310 formed according to an alternative embodiment. The closure comprises: an outer shell 320; an outer locking part 380; an inner locking part 385; a pourer body 390; and a one-way valve assembly 395. The closure is shown fitted to a container neck 315, with the body 390 being snap-fitted over a locking bead 316 and a tuck-in bead 360 on the shell securing it to the body.

From the position shown in FIG. 8A rotation of the closure first causes the outer part to ratchet up with respect to the inner part, which causes the shell to break along line 355. A first gap G1 is formed as shown in FIG. 8B and the outer part is locked to the inner part so that the gap cannot be closed.

Subsequently the outer part 380 splits along a line of weakness 381 so that a lower section 382 remains locked on the inner part 385 and an upper section 383 continues to rotate with respect to the inner part. This causes the shell to break along line 340 and a second gap G2 to be formed as shown in FIG. 8C. The section 383 becomes locked to the inner part so that the gap cannot be closed.

Further rotation now causes the inner part 385 to rotate relative to the pourer body and to break along line 386. The top section of the closure can now be rotated off the body to allow dispensing through the valve assembly and the pourer. In this respect the closure is similar to the closure 110 shown in FIGS. 4 and 5.

Figure 9:
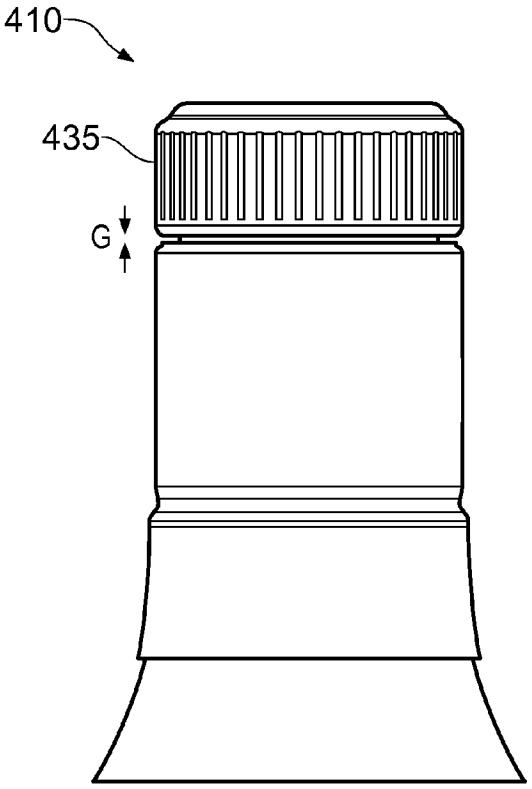
FIG. 9 is a side elevation of a closure formed according to an alternative embodiment and shown in an activated position.

Referring now to FIG. 9 there is shown a closure 410 formed according to an alternative embodiment. The closure 410 is different from the closures shown in FIGS. 1 to 8 in that only a single gap G is generated in the activated state. This single gap may be generated in a similar manner to the way gap G1 or G2 is generated in FIGS. 3 and 4.

In this embodiment the closure is opened by removal of only the shell section 435 along with its internal ratchet components 475. The top cap provided by the shell section 435 and components 475 is friction fitted to the pourer body 470 so that it is lifted away to reveal the body 470. Once the top cap (e.g., the top cap comprising components 435, 475) is replaced the closure 410 returns to the position shown in FIG. 9 in which the gap G cannot be re-closed.

The top shell section 435 may be friction fitted to the pourer body 470 by a push fit arrangement, such that removal of the top shell section 435 in an opening event causes an audible sound to be generated. The audible sound may be a pop sound. Further, in addition or as an alternative to the audible sound, the top shell section 435 may be fitted to the pourer body 470 such that a vibration or other tactile sensation may be provided to the user as a result of the opening event. As will be appreciated, an audible sound and/or tactile sensation may also be provided as a result of a closing event in which the top shell section 435 is reapplied to the pourer fitment 470.

By providing a sound and/or tactile sensation to the user as a result of an opening and/or closing event, the user experience of opening and/or closing the closure may be improved.

Figure 10:
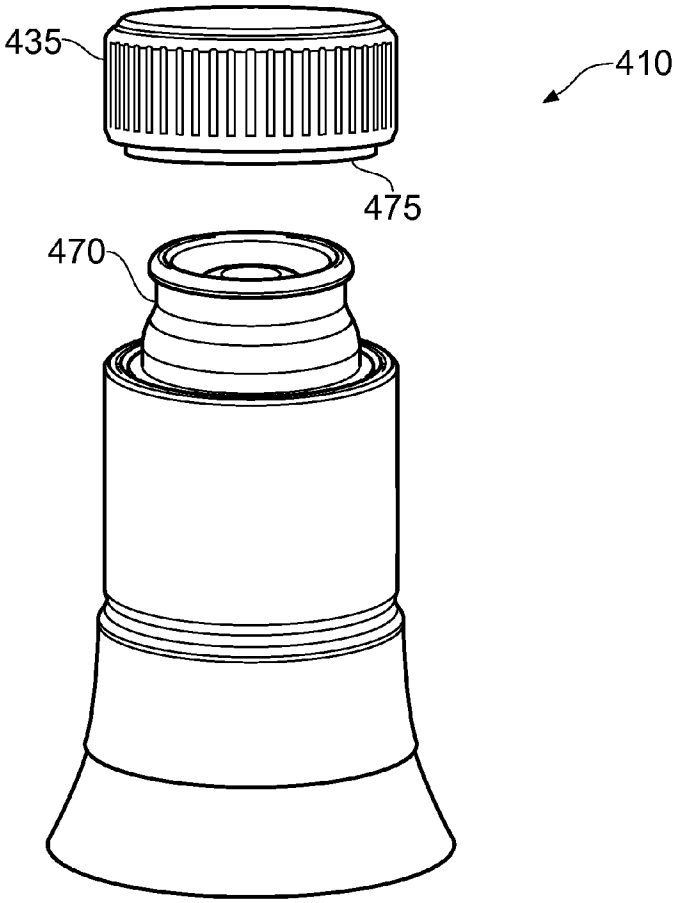
FIG. 10 is a perspective view of the closure of FIG. 9 shown with a top cap removed.

It is noted that in the embodiment of FIGS. 9 and 10, the closure 410 consists of a single generated gap G only. In other words, the closure 410 has one and only one gap G and no other gaps are generated.

Although FIG. 9 shows the single gap G being positioned directly below the top shell section 435, it should be appreciated that a single gap may be generated at any position on the closure. For example, the single gap may instead be generated in the same position as the gap G1 shown in FIGS. 4 to 8.

The invention claimed is:

1. A tamper-evident closure for a container, the closure comprising a first shell section, a second shell section arranged below the first shell section, and a third shell section arranged below the second shell section, wherein during an opening event, the closure is moved from a first position to an intermediate position and then to a second fully open position in which the first shell section can be removed to reveal a pouring aperture, the movement from the first position to the intermediate position generating a first gap between the second and third shell sections, and the movement from the intermediate position to the second position generating a second gap between the first and second shell sections, the closure comprising means for preventing closing of the gaps whereby to confirm the opening event has occurred.

2. The closure as claimed in claim 1, in which the gaps are generated sequentially.

3. The closure as claimed in claim 1, in which at least one of the gaps is unobstructed.

4. The closure as claimed in claim 1, in which at least one of the gaps is obstructed.

5. The closure as claimed in claim 1, in which at least one gap is generated by rotation.

6. The closure as claimed in claim 1, in which at least one gap is generated by axial separation.

7. The closure as claimed in claim 1, in which the means for preventing closing of the gaps include one or more ratchet arrangements.

8. The closure as claimed in claim 1, in which the gaps are generated at least in part using differential torque between sections of the closure.

9. A tamper-evident closure for a container, the closure including an outer shell and a pouring fitment and being movable from an unactivated, first position to an activated, second position in which fluid can be dispensed from the pouring fitment in an opening event, the pouring fitment comprising external screw thread formations co-operating with corresponding formations provided on an internal ratchet component within the shell, the shell being separable into three or more parts in the opening event so as to form two or more gaps, the closure comprising means for preventing closing of the gaps whereby to confirm the opening event has occurred.

10. The closure as claimed in claim 9, in which the shell parts are initially connected by lines of weakness.

11. The closure as claimed in claim 9, in which the means for preventing closing of the gaps include one or more ratchet arrangements.

12. The closure as claimed in claim 9, in which some or all of the gaps are generated sequentially.

13. The closure as claimed in claim 9, in which some or all of the gaps are generated substantially simultaneously.

14. The closure as claimed in claim 9, in which at least one of the gaps is unobstructed.

15. The closure as claimed in claim 9, in which at least one of the gaps is obstructed.

16. The closure as claimed in claim 9, in which at least one gap is generated by rotation or axial separation.

17. A tamper-evident closure for a container, the closure including an outer shell comprising a first shell section friction fitted to a pouring fitment of the closure and a second shell section arranged below the first shell section, the first shell section comprising internal ratchet components, wherein in an opening event, the closure is moved from a first position to a second position in which the first shell section can be lifted away to reveal a pouring fitment of the closure, the movement to the second position generating a single gap between the first shell section and the second shell section, the closure comprising means for preventing closing of the single gap.

* * * * *